US007213728B2

(12) United States Patent
Kutsch et al.

(10) Patent No.: US 7,213,728 B2
(45) Date of Patent: May 8, 2007

(54) TIME DELAY AND INDICATOR ACTUATOR ASSEMBLY FOR AEROSOL CONTAINERS

(75) Inventors: John H. Kutsch, Harvard City, IL (US); Vincent R. Lackowski, Harvard City, IL (US); Nathan R. Westphal, Union Grove, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 510 days.

(21) Appl. No.: 10/875,341

(22) Filed: Jun. 24, 2004

(65) Prior Publication Data

US 2005/0284897 A1 Dec. 29, 2005

(51) Int. Cl.
*G04C 23/42* (2006.01)

(52) U.S. Cl. ..... 222/649; 222/1; 222/54; 222/153.06; 222/153.12; 222/402.1; 222/402.13; 222/402.14

(58) Field of Classification Search ..... 222/649
See application file for complete search history.

(56) References Cited

U.S. PATENT DOCUMENTS

| | | | | |
|---|---|---|---|---|
| 1,973,182 | A | 9/1934 | Shaw | |
| 2,244,302 | A | 6/1941 | Lynn et al. | |
| 2,759,768 | A | 8/1956 | Sato | |
| 3,235,126 | A | 2/1966 | Shay | |
| 4,195,745 | A | 4/1980 | Roberts et al. | |
| 4,607,664 | A | 8/1986 | Carney et al. | |
| 4,823,986 | A | 4/1989 | Pearce, III | |
| 5,791,524 | A | 8/1998 | Demarest | |
| 6,142,346 | A | 11/2000 | Aderholt et al. | |
| 6,223,937 | B1 | 5/2001 | Schmidt | |
| 6,688,492 | B2 | 2/2004 | Jaworski et al. | |
| 6,695,227 | B1 * | 2/2004 | Hayashi et al. | 239/337 |
| 2002/0020715 | A1 | 2/2002 | Gueret | |

FOREIGN PATENT DOCUMENTS

| | | |
|---|---|---|
| JP | 62019275 | 1/1987 |
| JP | 10337507 | 12/1998 |
| JP | 11028396 | 2/1999 |
| JP | 11290729 | 10/1999 |

* cited by examiner

*Primary Examiner*—J. Casimer Jacyna

(57) ABSTRACT

An actuator assembly is disclosed which can dispense chemicals, such as insect control ingredients, from an aerosol container. The actuator assembly is mountable to the aerosol container and includes a burstable barrier and an extrudable (e.g. paste) plug. Upon initial activation, the pressure from inside of the container presses the burstable barrier which in turn presses the paste plug to cause at least a portion of the plug to move to a position where it is visible and provides a cue that a delay period has started. The device can be manually activated, but is designed so that thereafter it does not need to be manually held open. The user has time to leave the room before spraying begins, and does not need to be present in the room before spraying has finished.

14 Claims, 1 Drawing Sheet

TIME DELAY AND INDICATOR ACTUATOR ASSEMBLY FOR AEROSOL CONTAINERS

CROSS-REFERENCE TO RELATED APPLICATIONS

Not applicable.

STATEMENT REGARDING FEDERALLY SPONSORED RESEARCH/DEVELOPMENT

Not applicable.

BACKGROUND OF THE INVENTION

The present invention relates to aerosol dispensing devices, and in particular to actuator assemblies that provide a regulated time delay between the initial activation of the devices and the actual release of the aerosol contents to the ambient environment. More particularly it relates to devices that can be used with aerosol containers to dispense in this manner while providing a visual cue that the device is in the process of being activated. "Aerosol", as used herein, includes all pressurized materials delivered in a manner or from containers and via actuators and other delivery systems comparable to those used with materials that literally form aerosols.

Aerosol containers dispense a variety of ingredients. One or more chemicals to be dispensed are usually mixed in a solvent and, in any event, are mixed with a propellant. Typical propellants are compressed air or other compressed gases, carbon dioxide, a selected hydrocarbon gas, or mixtures of hydrocarbon gases, such as a propane/butane mix. For convenience, materials being dispensed will be referred to herein merely as "chemical(s)," regardless of their chemical nature or intended function. Without limitation, chemicals can include actives such as insect control agents (e.g. a repellent, insecticide, or growth regulator), fragrances, sanitizers, cleaners, waxes or other surface treatments, and/or deodorizers.

The active/propellant mixture is stored under pressure in the aerosol container. The mixture is then sprayed out of the container by pushing down or sideways on an activator button, lever, or other structure at the top of the container that controls a release valve mounted at the top end of the container. The sprayed active may exit in an emulsion state, single phase, multiple phase, and/or be partially gaseous.

The aerosol container contents can be released via manual pressure (for as long as such manual pressure is provided). Alternatively, an actuator can be provided that latches or switches the release valve in an on position such that essentially the entire contents of the can are automatically dispersed in a single continuous, albeit elongated, burst (e.g. total release foggers), or by intermediate spaced bursts (e.g. automatic dosing systems).

U.S. Pat. No. 4,823,986 discloses a system for providing a time delay between the initial activation and the actual release of the contents. This provides the operator time to leave the immediate area to avoid being exposed to the chemicals being dispensed. This is especially desirable when the active being dispensed is an insecticidal fumigant. The disclosures of this patent, and of all other patents and patent applications referred to herein are incorporated herein by reference as if fully set forth.

For other time delay systems, see also U.S. Pat. Nos. 2,244,302 and 2,759,768, and (assigned to the assignee of the instant application) U.S. Ser. No. 10/845,692, filed May 14, 2004, for "Friction Resistant Time Delay Actuator Assemblies For Aerosol Containers".

However, other delay systems have a variety of deficiencies. For example, once they are initiated there is some possibility that a user may be reluctant to leave the area because the user is not sure that the device is working. Such a user might therefore be exposed to the sprayed chemicals as a consequence of having stayed too close for too long.

In any event, many such systems are expensive to manufacture, rendering them impractical, and/or have other deficiencies. Hence, a need remains to provide improved, inexpensive, and reliable time delay systems for such purposes, and particularly systems that provide a visual cue as to when the delay period countdown has started.

BRIEF SUMMARY OF THE INVENTION

The invention provides an actuator assembly suitable for dispensing a pressurized chemical from an aerosol container to ambient environment, albeit with a time delay after initial activation of the actuator assembly, the aerosol container having a release valve for controlling the release of the chemical from the container to the ambient environment. The actuator assembly includes an actuator mountable on the aerosol container to be operably connectable to the release valve for at least initially activating the release valve, the actuator including a flow path through which chemical from the container must pass when released there from.

A time delay system is associated with the release valve, the time delay system including a burstable barrier and an extrudable plug, both of which initially close the flow path. Upon initial activation of the actuator assembly, chemical thus released from the container must both burst the burstable barrier and also extrude or penetrate the extrudable plug before escaping to the ambient environment.

Preferably, upon initial activation of the actuator assembly at least a portion of the extrudable plug will move to a position visible to a user of the assembly such that appearance of that portion at the visible position acts as an indication that a time delay period has begun.

In preferred forms, upon initial activation of the actuator assembly to release pressurized chemical via the release valve, the barrier will begin to bulge and thereby contact and push against a portion of the plug. In this form, the bulging surface of the barrier acts much like the face of a piston, providing an initially unbroken surface urging the plug forwardly, to extrude it. In turn, the plug, having a tendency to only slowly extrude, supports the burstable barrier, preventing its sudden distortion under the chemical's pressure and slowing its reaching the point where it finally bursts, to only then directly expose the plug to the pressurized chemical.

This arrangement is advantageous as it both delays the bursting of the barrier and minimizes the possibility of small channels being formed through the plug by the pressurized chemical. Such channeling can cause the pressurized chemical to begin dispensing even with only minimal extrusion of the plug and then possibly to continue at a too slow rate.

In other forms the plug is colored with a visually noticeable color and preferably a color selected from the group consisting of yellow, orange or red, which users will readily understand as a warning color. However, green, blue, or indeed any visually noticeable color is also usable. Preferably, the color of the plug contrasts with the color of a portion of the actuator assembly adjacent to the location from which the plug is extruded. The barrier can be membrane-like, such as in the form of a sheet (preferably a thin plastic sheet), and the plug in the form of a paste (such as one formed from a mixture of silicone grease and talc or formed from any high viscosity, flowable material).

Upon initial activation the actuator assembly can, after a delay period, dispense essentially all of the chemical in the container without further outside manual intervention, optionally in a continuous single burst. The time delay can be at least five, preferably ten, and (even more preferred) at least twenty seconds between initiation and spray release. This will permit users adequate time to see the warning color of the plug becoming visible, and then leave the area.

It should be appreciated that as the container pressure is released to act on the barrier, the barrier first begins to bulge. The bulging can drive a sufficient amount of the plug out an orifice to provide the visual cue. Continued bulging will cause the barrier to burst, thereby permitting the container contents to exit.

As noted, above, both the burstable barrier and the extrudable plug contribute to the delay and can do so in a synergistic fashion. Thus, by itself, the burstable barrier may quickly distort and burst under the pressure of the container's chemicals. By itself, the extrudable plug may also provide only brief actuation delay in that the pressurized chemicals may quickly tunnel through it, creating a channel in the plug through which the contents may escape without having to expel more than a small amount of the plug.

However, in the actuator assembly of the invention such channeling cannot occur until the burstable barrier has broken, while the burstable barrier can distort toward the point at which it will burst only as quickly as the extrudable plug is expelled to create a space into which the barrier can distort. Working together, these two parts of the invention interact in such a way that each part prevents the tendency of the other part to release pressurized chemical from the container too suddenly.

Alternatively, something in the chemical in the container can interact with the burstable barrier to cause it to undergo chemical degradation. Given the above criteria, it is well within the capability of a skilled artisan to select suitable materials and construct the barrier and plug. In any event, we note that our preferred materials for making the burstable barrier include but are not limited to polyester (e.g., 2–4 mil), low-density polyethylene (e.g., 2–4 mil), and other thin plastics.

The extrudable plug is preferably made of a non-drip paste material. The preferred paste is a combination of a silicone grease, such as Dow #112 sold by Dow Corning Corporation of Midland, Mich., U.S.A., and finely ground talc, such as is present in conventional baby powders. The preferred weight percent ratio of talc to grease is about 45 to 55.

Silicone grease offers the advantages of being inert and temperature stable. Dow #112, for example, is stable over a temperature range of about −30° C. to 83° C. However, a variety of other greases and viscous materials could be used to provide the core of the extrudable material.

The other preferred component is a powder-like material such as a talc. Talc serves as a binder, converting the grease to a smoother paste, and further modifies the speed at which the material extrudes from the exit orifice and limits migration or flow of the grease prior to use.

Of course, still other extrudable materials could be provided such as petroleum-based or synthetic greases, Teflon® pastes, clay pastes, and the like.

In another aspect, the invention provides a method for dispensing a chemical from an aerosol container that has a release valve for controlling the release of the chemical from the container to the ambient environment. The method includes the steps of first obtaining an actuator assembly having an actuator mountable on the aerosol container to be operably connectable to the release valve for at least initially activating the release valve. The actuator includes a flow path through which chemical from the container must pass when released there from and a time delay system associated with the release valve, the time delay system including a burstable barrier and an extrudable plug, both of which initially close the flow path. One then initially activates the actuator assembly so that chemical thus released from the container must both burst the burstable barrier and also extrude or penetrate the extrudable plug before escaping to the ambient environment.

Preferably, when one initially activates the actuator assembly so that the barrier can be caused to bulge and then burst, while it is bulging the barrier will cause at least a portion of the extrudable plug to move to a position visible to a user of the assembly. One then dispenses after a delay period, at least a portion of the chemical to the ambient environment.

When the plug is colored, any means of providing the color is intended. For example, either the talc or grease could be mixed with a dye (mixing it with the talc is preferred). Alternatively, the plug could be a white or neutral color which is made more visible by contrast with the color of the actuator cap.

The present invention is most suitable for use with insect fogger products. Upon initial activation the actuator assembly can dispense essentially all the chemical in the container without further outside manual intervention, in a continuous single burst, albeit with an initial time delay. Alternatively, the valve can be used with automatic intermittent sprayers where the dispensing is still essentially total, but takes place with multiple separated bursts.

Apart from the above advantages, the time delay/indicator system of the present invention is inexpensive to produce, and suitable to be used with a variety of existing total release valves. It has reliable time delay characteristics.

The foregoing and other advantages of the invention will become apparent from the following description. In the following description reference is made to the accompanying drawings which form a part thereof, and in which there is shown by way of illustration preferred embodiments of the invention. Such embodiments do not represent the full scope of the invention. Reference should therefore be made to the claims herein for interpreting the scope of the invention.

DETAILED DESCRIPTION OF THE PREFERRED EMBODIMENTS

Figure 1:
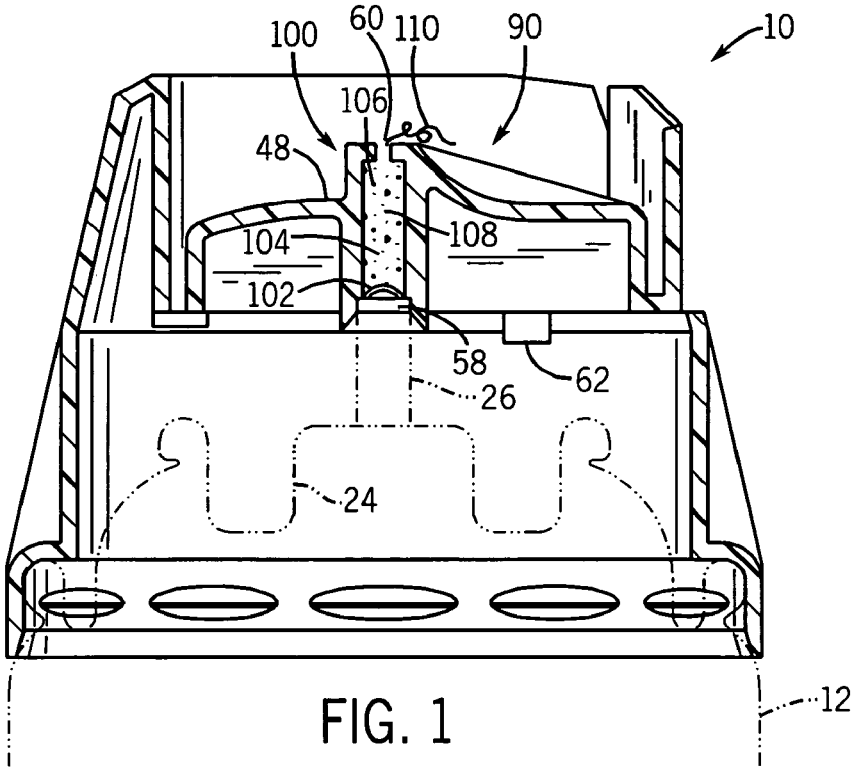
FIG. 1 is a vertical cross sectional view of an aerosol can cap with associated container, where the depicted structure embodies the present invention.
Figure 2:
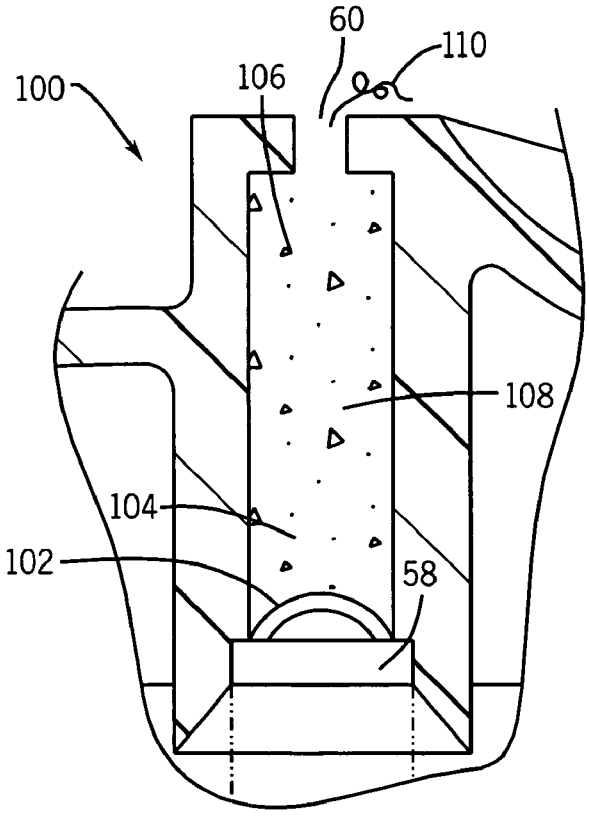
FIG. 2 is an enlarged view of a portion of FIG. 1.

FIGS. 1 and 2 show a cross sectional view of a preferred embodiment of an actuator assembly 10 of the present invention, as embodied in an aerosol actuator cap depicted and described in U.S. Pat. No. 5,791,524. As stated above, the disclosure of that patent, and of all other patents and patent applications referred to herein, are incorporated by reference as if fully set forth herein.

Actuator assembly 10 is configured to be useful with conventional aerosol containers, such as the one partially shown at 12 in phantom lines in FIG. 1. Such conventional aerosol containers include release valves such as the release valve 24. The release valve 24 shown is a male valve, with a projecting valve stem 26. However, it will be apparent to one skilled in the art that the actuator assembly of the invention can be adapted for use with a conventional female valve.

Actuator assembly 10 includes an actuator 90 and a time delay system 100. The release valve and the actuator 90 are as depicted and described in U.S. Pat. No. 5,791,524. The time delay system 100 contains a burstable barrier 102 made of a plastic sheet over which is mounted an extrudable plug 104 made of a paste material 106.

The burstable barrier 102 seals a valve stem socket 58, which receives the valve stem 26 when actuator 90 is activated. The paste material 106 fills a flow path 108 between barrier 102 and an exit orifice 60. All other parts in FIGS. 1 and 2, such as container 12, trigger 48, and latch 62, as well as their operation, are as depicted and described in U.S. Pat. No. 5,791,524.

Burstable barrier or membrane 102 is fastened across the stem socket 58 so as to seal the stem socket when the valve stem 26 is received therein. If desired, the burstable barrier 102 can be sealed to the stem socket 58 even prior to the valve stem's being received therein, with the barrier being fastened by any suitable means, such as heat staking, use of an adhesive, or use of a mechanical fastening method, such as a clamp, O-ring, or the like.

This sealed arrangement can contribute to preventing downward loss of the paste material 106 prior to use. However, if the paste material employed is sufficiently sticky to hold the barrier in place prior to activation and is thick enough so that prior-to-use loss is not a problem, no separate fastening means is necessary. The fit between the stem socket 58 and the valve stem 26 can be sufficiently snug once the valve stem is engaged in the stem socket that the burstable barrier 102 will simply be held between them in sealing relation.

When the actuator is activated by manually depressing trigger 48 until latch 62 engages the trigger to retain it in a valve-open position (compare the mechanism of U.S. Pat. No. 5,791,524), the active/propellant mix from inside of the container drives barrier 102 to bulge upward, pushing on the underside of the mass of paste 106 so that a portion of the paste is extruded from exit orifice 60 as an activation cue to the user (extruded paste is depicted schematically at 110). After a certain period of time, the barrier 102 bursts open under container pressure and the remaining paste 106 is then directly pushed by the container pressure to exit the exit orifice 60, albeit slowed by the viscosity of the paste, until an exit path is eventually formed for the release of the chemical. The chemical is then released to the environment.

The above system can provide for total release of the contents of an aerosol container with only an initial manual intervention. Upon viewing the initial extrusion of the paste material from the exit orifice, the user will be warned that the user has only a short additional period to leave before spray begins to exit the device. The overall defined period can be designed to be about 60 seconds or more, but preferably is on the order of about 5–30 seconds, with the delay after the paste is visible being at least 5, preferably 10, and (even more preferred) at least 20 seconds. Then, the user knows that container 12 should be left by itself until the container's contents are discharged.

The chemical may be dispensed with a single continuous, albeit prolonged, burst. Alternatively, a system analogous to that shown in U.S. Pat. No. 6,688,492 can be modified to have its outlet converted with a time delay conduit and plug, so as to provide an automatic dispensing valve that iterates between on and off automatically. With such a system multiple segregated bursts could be dispensed, albeit after an initial time delay.

Apart from the burstable barrier 102 and plug 104 of the time delay mechanism, the actuator assembly may be mostly molded from conventional plastics by injection molding or other standard means. The burstable barrier 102 is preferably made from polyester or low-density polyethylene of 2 to 4 mil and the plug 104 is (as previously noted) made from a combination of a silicone grease and a fine-ground talc, such as baby powder-type talc.

The above description has been that of a preferred embodiment of the present invention. It will occur to those that practice the art, however, that still other modifications may be made without departing from the spirit and scope of the invention. For example, the paste may be spaced slightly upward from the burstable barrier so that the burstable barrier bursts before any movement of the plug. Of course, this is not the preferred manner of operation.

Similarly, the paste may be under the burstable barrier, with the paste being sufficiently cohesive so as to be able to act as a piston to burst the burstable barrier. Again, this is not a preferred version.

With respect to what can be an extrudable plug, the plug must be of a material that will flow in response to pressures caused by the container pressure. However, the plug cannot merely be a gas, as that would not perform a plugging function. Instead, a variety of flowable pastes and gels are preferred, albeit some highly viscous liquids may also suffice.

In any event, in order to advise the public of the various embodiments that may fall within the scope of the invention, the following claims are made.

INDUSTRIAL APPLICABILITY

The present invention provides actuator assemblies useful for dispensing chemicals from aerosol containers in a time-delayed fashion, together with a visual cue as to the start of the time delay period.

We claim:

1. An actuator assembly suitable for dispensing a pressurized chemical from an aerosol container to ambient environment, albeit with a time delay after initial activation of the actuator assembly, the aerosol container having a release valve for controlling the release of the chemical from the container to the ambient environment, the actuator assembly comprising:

an actuator mountable on the aerosol container to be operably connectable to the release valve for at least initially activating the release valve, the actuator including a flow path through which chemical from the container must pass when released there from; and a time delay system associated with the release valve, the time delay system including a burstable barrier and an extrudable plug, both of which initially close the flow path, the barrier being positioned between the plug and release valve;

whereby, upon initial activation of the actuator assembly, pressure of the chemical thus released from the container can both burst the burstable barrier and also then cause the chemical to extrude or penetrate the extrudable plug before escaping to the ambient environment.

2. The actuator assembly of claim 1, whereby, upon initial activation of the actuator assembly, the barrier will begin to bulge and thereby push and extrude a portion of the plug, and only thereafter the barrier will burst.

3. The actuator assembly of claim 1, wherein the barrier is in the form of a sheet.

4. The actuator assembly of claim 1, wherein the barrier is in the form of a burstable membrane.

5. The actuator assembly of claim 1, wherein, upon initial activation, the actuator assembly can, after a delay period, dispense essentially all of the chemical in the container without further outside manual intervention.

6. The actuator assembly of claim 5, wherein the actuator assembly can dispense essentially all of the chemical in the container in a continuous single burst.

7. The actuator assembly of claim 1, wherein a time delay between initial activation of the release valve and the first exit of the chemical to be dispensed to said ambient environment from the container as a result thereof is at least 5 seconds.

8. The actuator assembly of claim 1, wherein a time delay between initial activation of the release valve and the first exit of the chemical to be dispensed to said ambient environment from the container as a result thereof is at least 20 seconds.

9. The actuator assembly of claim 1, wherein, upon initial activation of the actuator assembly, at least a portion of the extrudable plug will move to a position visible to a user of the assembly such that appearance of that portion at the visible position acts as an indication that a time delay period has begun.

10. The actuator assembly of claim 9, whereby the plug has a color contrasting with that of a part of the actuator assembly adjacent to the portion of the extrudable plug that becomes visible to a user.

11. An actuator assembly suitable for dispensing a pressurized chemical from an aerosol container to ambient environment, albeit with a time delay after initial activation of the actuator assembly, the aerosol container having a release valve for controlling the release of the chemical from the container to the ambient environment, the actuator assembly comprising:

an actuator mountable on the aerosol container to be operably connectable to the release valve for at least initially activating the release valve, the actuator including a flow path through which chemical from the container must pass when released there from; and a time delay system associated with the release valve, the time delay system including a burstable barrier and an extrudable plug, both of which initially close the flow path;

whereby, upon initial activation of the actuator assembly, chemical thus released from the container must both burst the burstable barrier and also extrude or penetrate the extrudable plug before escaping to the ambient environment;

wherein the plug is in the form of a paste; and wherein the paste comprises a grease and a powder.

12. The actuator assembly of claim 11, wherein the grease is a silicone grease.

13. The actuator assembly of claim 11, wherein the powder is talc.

14. A method for dispensing a chemical from an aerosol container that has a release valve for controlling the release of the chemical from the container to the ambient environment, the method comprising the steps of:

a. obtaining an actuator assembly having an actuator mountable on the aerosol container to be operably connectable to the release valve for at least initially activating the release valve, the actuator including a flow path through which chemical from the container must pass when released there from; and a time delay system associated with the release valve, the time delay system including a burstable barrier and an extrudable plug, both of which initially close the flow path, the barrier being positioned between the plug and release valve; and b. initially activating the actuator assembly so that pressure of chemical thus released from the container must both burst the burstable barrier and also then cause the chemical to extrude or penetrate the extrudable plug before escaping to the ambient environment.

* * * * *